United States Patent [19]

Jen

[11] 4,455,121

[45] Jun. 19, 1984

[54] ROTATING TURBINE STATOR

[75] Inventor: Hsianmin F. Jen, Milford, Conn.

[73] Assignee: Avco Corporation, Stratford, Conn.

[21] Appl. No.: 438,038

[22] Filed: Nov. 1, 1982

[51] Int. Cl.[3] ..... F01D 9/00

[52] U.S. Cl. ..... 415/143; 415/146; 415/147; 415/211; 415/219 A

[58] Field of Search ..... 415/143, 146, 147, 211, 415/219 A; 60/39.36

[56] References Cited

U.S. PATENT DOCUMENTS

| | | | |
|---|---|---|---|
| 1,097,729 | 5/1914 | Rice | 415/143 |
| 2,594,042 | 4/1952 | Lee | 415/147 |
| 3,006,603 | 10/1961 | Caruso | 415/211 |
| 3,208,389 | 9/1965 | Stefan | 415/147 |
| 3,722,215 | 3/1973 | Zhdanov | 415/143 |
| 3,868,196 | 2/1975 | Lown | 415/211 |
| 3,941,501 | 3/1976 | Shank | 415/147 |
| 4,151,709 | 5/1979 | Mellonian et al. | 60/39.36 |
| 4,264,272 | 4/1981 | Weiler | 415/211 |

FOREIGN PATENT DOCUMENTS

| | | | |
|---|---|---|---|
| 121724 | 7/1946 | Australia | 415/417 |
| 706213 | 4/1941 | Fed. Rep. of Germany | 415/147 |
| 931344 | 2/1948 | France | 415/147 |

*Primary Examiner*—Stephen Marcus
*Assistant Examiner*—Kwon John
*Attorney, Agent, or Firm*—Ralph D. Gelling

[57] ABSTRACT

Hot spots in the first stage turbine nozzles of small and medium sized engines are eliminated by spinning the nozzle assembly which consists of an annular hub circumscribed by a nozzle diaphragm having an inner and outer shroud ring between which are a multiplicity of symmetrically positioned vanes of airfoil design. Power to turn the nozzle assembly is obtained by connecting it to a rotary-type, vaned diffuser stage which lies in radial alignment with the impeller of the engine compressor. The rotary diffuser and nozzle combination is configured to turn at 50–1,000 rpm enabling the combined assembly to be mounted on unlubricated ceramic bearings.

6 Claims, 3 Drawing Figures

ROTATING TURBINE STATOR

BACKGROUND OF THE INVENTION

This invention relates to improvements in turbine nozzles used in turbine engines having centrifugal compressors. Of particular concern is the elimination of combustor hot spot effects on turbine nozzles associated with small and medium sized engines.

It is known to make diffusers which include a rotary stage. U.S. Pat. No. 3,941,501 to Shank discloses a first stage vaneless diffuser having rotating sidewalls which freely turn on bearings mounted coaxially with the compressor. U.S. Pat. No. 3,868,196 to Lown shows a rotating vaneless diffuser which is powered by leakage flow from the impeller disk of the compressor. Both of the above patents disclose means for efficiently matching a diffuser to a compressor rotor which delivers gas at supersonic velocity. They do this by introduction of a rotating stage having sidewalls which travel at about half that of the impeller. In this way, gas molecules impact the diffuser sidewalls at subsonic velocities thereby minimizing shock wave phenomena in the diffuser.

My rotary diffuser serves a different purpose. Torque is applied to my diffuser stage in an amount adequate to rotate a first nozzle disk positioned at the outlet of the engine combustors. By spinning the turbine nozzle system disk at a nominal rate, hot spot effects do not develop on those nozzle blades which are directly in front of the combustor exit. Rather, each balde would spend about 20 milli-seconds in the hottest part of the flame before moving into a slightly cooler environment. This reduces the total heat transfer rate to the vane. Consequently, the hot spot effect is eliminated or minimized.

SUMMARY OF THE INVENTION

This invention relates to a rotary diffuser and first stage turbine nozzle assembly which are joined together. The assembly freely rotates at a speed which depends on the summation of the frictional forces present at the bearings and seals taken in combination with the net torque developed by the gas stream which flows through both the diffuser and the nozzle. The result is to increase nozzle life and reliability by reducing combustor hot spot effects on those nozzle vanes or blades which are in line with the outlets of the combustor liners.

In my implementation, the first turbine nozzle consists of an annular hub circumscribed by a nozzle diaphragm having an inner and outer shroud ring between which there are a multiplicity of vanes of airfoil design. The hub region of the nozzle assembly is integrally connected with a rotary diffuser which lies in radial alignment with the impeller rotor of the compressor. The diffuser is configured so that compressed fluid is delivered radially outward from the periphery of the impeller between sidewalls that are rotating at nominal speed. The rotating sidewalls consist of two disks which are separated by a multiplicity of equispaced vanes. The disk on the upstream or compressor side is ring-shaped with an inner diameter which closely surrounds the periphery of the impeller. The disk on the downstream side of the impeller has both a portion which interfaces with the upstream disk and a portion which extends inwardly alongside the downstream face of the impeller. It is at the inner web of the diffuser disk where the junction is made with the nozzle assembly.

The diffuser-nozzle assembly is free to turn concentrically with the shaft which drives the compressor. The vances within the diffuser each have a wedge-shaped cross-section with the sharp edge facing the periphery of the impeller. Properly configured so that the centerline of each diffuser passageway lies on a line which is tangent to a circle having a radius slightly smaller than that of the impeller, there will be rotational torque developed by the diffuser stage. This results from the fact that gas molecules leave the impeller in a direction which is generally tangential to the periphery. These molecules will then strike the sidewalls and vane edges in such a way as to cause the diffuser to turn in the same direction as the impeller is rotating. The angle at which the passageway centerlines are pitched determines the driving speed of the diffuser.

With respect to the nozzle assembly, the purpose of the nozzle diaphragm is to accelerate and direct the flow of hot gases onto the buckets of the turbine wheel. The first turbine wheel will be turning in the same direction as the impeller since it is driven by it. Therefore, having the diffuser spin in the same direction as the impeller imparts an added rotational velocity to the hot gas stream impacting the turbine buckets. This means that the only efficiency degradation due to having a rotating diffuser-nozzle assembly is that due to friction losses at the bearings and seals.

In order to minimize the complexity of the bearing and seal system and the resulting impact of the assembly on the aerodynamic efficiency, the assembly should be designed to rotate at very low speed, in the range of 50–1000 RPM, possibly with a speed regulator. Since it is rotating at a low speed, there is no need for a lubricating system, allowing the bearing package to run dry with ceramic bearings. As a result of very low rotating speed, the hot spot effect is reduced significantly or eliminated. The additional mechanical system is kept simple and reliable.

DESCRIPTION OF THE PREFERRED EMBODIMENT

Figure 1:
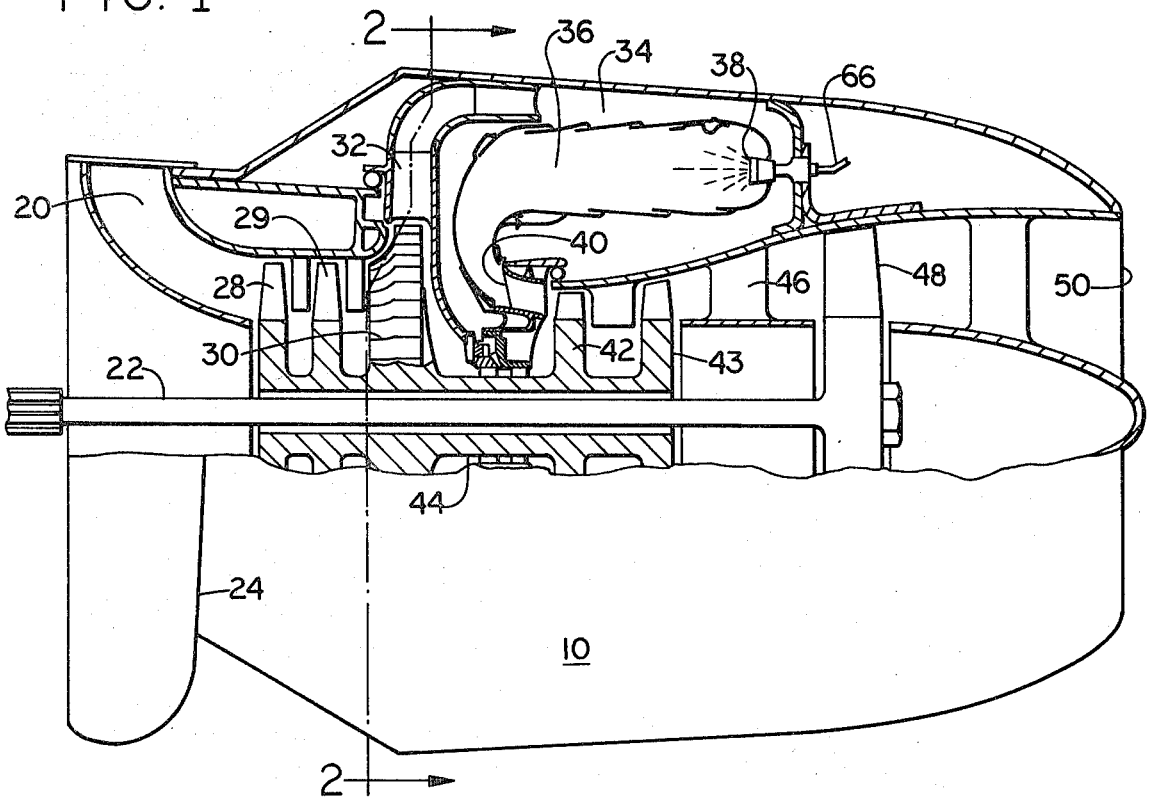
FIG. 1 is a partially cutaway view of a gas turbine engine typical of the type with which this invention is implemented.

FIG. 1 shows a turbine engine 10 which is typical of the type that can be improved by the incorporation of my invention. Engine 10 is a small turboshaft type having a circumferential air inlet duct 20 which is surrounded by an air shroud 24 which receives air from an air cleaner (not shown). Air entering duct 20 is compressed by first and second compressor stages 28 and 29. Radial impeller 30 directs the airflow outward to a diffuser 32. Pressurized air from the diffuser flows into air plenum 34 which supplies combustors 36. Fuel flowing in along supply lines 66 is injected into combustors 36 via fuel nozzles 38. The hot products of combustion flow axially inward to first turbine nozzle 40 and thence onward to first stage turbine disk 42. After passing first stage turbine disk 42, the hot gas stream flows through stator nozzles and has additional energy extracted at second stage turbine disk 43. Downstream of the second stage turbine is another set of stator nozzles 46 and a power extracting turbine stage 48 which drives an exterior load via shaft 22. Turbine stages 42 and 43 drive the compressor stages via hollow drive shaft 44. The still warm products of combustion flow out of the engine through tailpipe 50.

Figure 2:
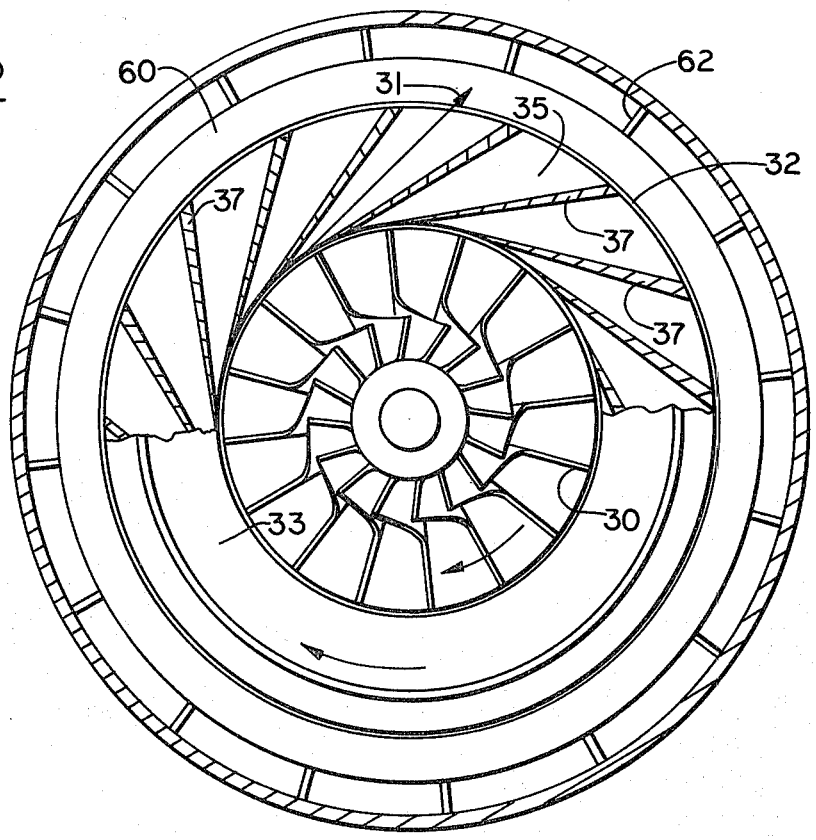
FIG. 2 is a cross-sectional view of the rotary diffuser stage taken along line 2—2 of FIG. 1.

FIG. 2 shows the diffuser and impeller in more detail. As viewed in FIG. 2, impeller 30 rotates clockwise. High velocity air leaves the periphery of the impeller in a direction which is essentially tangential to the outer edge (See arrow 31). The impeller 30 is closely surrounded by rotary diffuser 32. Diffuser 32 has front and rear sidewalls 33 and 35. The front and rear sidewalls are separated by a multiplicity of wedge-shaped vanes 37 which serve to define passageways through the rotary diffuser stage.

Compressible fluid leaves the impeller at high velocity striking both the front and rear sidewalls 33 and 35 as well as vanes 37. This imparts a rotative coupling force to the diffuser which tends to make it turn in the same direction as the impeller. The orientation of vanes 37 determines the ultimate rotational velocity of diffuser 32. By maintaining the orientation of the vanes such that they form passages whose centerlines are tangential to a common circle whose radius is about 5 percent less than the radius of impeller 30, the rotational rate of diffuser 32 is held to a nominal value of a few hundred RPM.

Surrounding the rotary diffuser stage is a vaneless annular stage 60 which redirects the outward directed air to a coaxial direction. A plurality of stator vanes 62 helps to evenly distribute the output from the compressor stages, thereby ensuring that all combustors receive an adequate supply of pressurized air.

Figure 3:
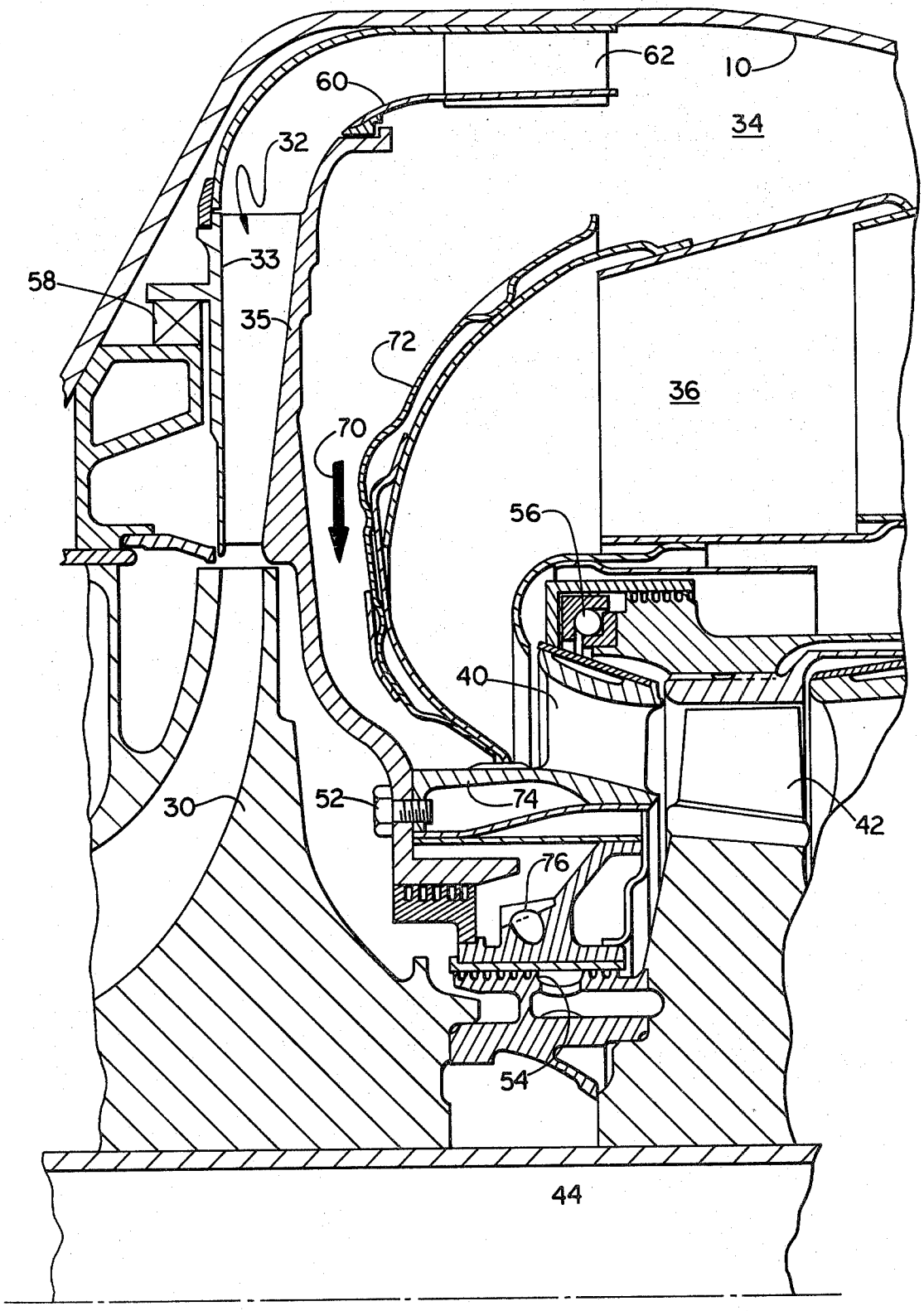
FIG. 3 is an expanded axial view of combination rotating diffuser and first turbine nozzle.

Turning now to FIG. 3, there is shown in greater detail the cooperation between the rotary diffuser stage 32 and the first turbine nozzle 40. As shown in FIG. 3, the rotary diffuser stage 32 is mechanically connected to the first turbine nozzle 40 by means of a plurality of bolts 52. Both diffuser stage 32 and nozzle 40 are configured as annular elements which, when joined together, have a common seal 54 that separates them from high speed hollow central shaft 44. The nozzle 40 rides on thrust bearing 56 and diffuser stage 32 rides on bearing race 58.

The shape of the individual blade cross-sections in nozzle 40 are such that the resulting torques due to aerodynamic forces on the diffuser and nozzles are approximately equal and opposite. As a consequence the diffuser-nozzle assembly will rotate freely at a speed which depends on the frictional drag of bearings 56 and 58 taken in combination with seal 54. It will be appreciated that in a modern turbine engine, shaft 44 will be rotating at speeds between 25,000 and 50,000 rpm. Thus, for the case where the diffuser-nozzle assembly turns at 50–200 rpm, there is more drag supplied by the seal than results from the bearings 56 and 58. This makes it feasible to use bearing packages which require no lubrication. Use of ceramic bearings simplifies the system requirements.

Additional cooling of the first stage turbine nozzle-diffuser assembly is obtained by tapping off pressurized air from plenum 34 and flowing it (See arrow 70) between rear sidewall 35 and heat shield 72 on the downstream end of combustor 36. Passageways 74 and openings 76 formed in the root structure of nozzle 40 permit cooling air to flow through nozzle assembly and the interior of first turbine stage 42 finally escaping downstream of the stator nozzle.

Pressure at the periphery or downstream end of rotary diffuser 32 will be higher than at the output of the impeller due to the action of the diffuser. This pressure difference assures that there will be sufficient air leakage to form an air bearing along the outer face of sidewall 33. The inward flow of air along sidewall 33 also serves to cool bearing race 58 while at the same time providing an air bearing which dampens vibrations.

It will be understood that the rotating structure does not have to be supported on bearing races 56 and 58. The diffuser-stator assembly could also be configured to be supported on the shaft which drives the compressor. When supported by bearings and seals placed on the driving shaft, both must be lubricated since rotational velocities could exceed 20,000 rpm.

It is to be understood that the invention is not limited to the specific embodiment shown in the drawings. Changes in dimensional ratios may be required as the capacity of the diffuser and the first turbine nozzle are changed from one engine to another. Bearings and seals can also be varied while maintaining the spirit of the invention. Also, the number and orientation of the passageways through the diffuser can likewise be varied to suit design requirements spanning fluid velocities which range from subsonic to supersonic.

I claim:

1. In a gas turbine engine having an integrally connected rotary diffuser and first stage turbine nozzle assembly useful with a centrifugal compressor of the type having a shaft-driven radial-flow impeller for delivering compressible gas, said diffuser-nozzle assembly comprising:

a rotary diffuser stage having a pair of annular axially spaced front and rear sidewalls, each of said sidewalls having an inner and an outer circumference, said inner circumference closely surrounding the periphery of said impeller, said diffuser stage further having a plurality of symmetrically arranged wedge-shaped vanes mounted between said spaced sidewalls, the annular space between said sidewalls and said vanes defining flow passages for receiving gas radially discharged from said impeller, said diffuser stage being mounted for rotation substantially about the axis of the engine; and a first stage turbine nozzle consisting of an annular hub circumscribed by a nozzle diaphragm having an inner and outer shroud ring between which there are a multiplicity of symmetrically positioned vanes of airfoil design, the hub region of the turbine nozzle being integrally connected with said rear sidewall of said diffuser, said first stage turbine nozzle being mounted for rotation with said diffuser.

2. The invention as defined in claim 1 wherein the centerline of each diffuser passageway lies on a line which is tangent to a circle having a radius which is less than the radius of said impeller.

3. The invention as defined in claim 2 wherein the radius of said tangent circle is such that the rotary diffuser turns at a rate which is less than 1,000 rpm.

4. The invention as defined in claim 1 wherein the diffuser and first stage nozzle assemblies are mounted for rotation on ceramic bearings.

5. The invention as defined in claim 1 and including rotary seals for controlling the leakage of compressed fluids.

6. The invention as defined in claim 1 and including additional cooling of nozzle diaphragm vanes by bleed-off of air from the outlet side of said compressor.

* * * * *